US009004857B2

(12) United States Patent
Magara et al.

(10) Patent No.: US 9,004,857 B2
(45) Date of Patent: Apr. 14, 2015

(54) BARREL-SHAPED CENTRIFUGAL COMPRESSOR

(75) Inventors: Yohei Magara, Mito (JP); Kazuyuki Yamaguchi, Kasumigaura (JP); Mitsuhiro Narita, Tsuchiura (JP); Haruo Miura, Tsuchiura (JP); Naohiko Takahashi, Tsuchiura (JP); Akira Endo, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 966 days.

(21) Appl. No.: 13/166,066

(22) Filed: Jun. 22, 2011

(65) Prior Publication Data

US 2011/0318163 A1 Dec. 29, 2011

(30) Foreign Application Priority Data

Jun. 23, 2010 (JP) ..... 2010-142161

(51) Int. Cl.
*F04D 29/08* (2006.01)
*F04D 29/42* (2006.01)
*F04D 29/62* (2006.01)

(52) U.S. Cl.
CPC ..... *F04D 29/4206* (2013.01); *F04D 29/624* (2013.01)

(58) Field of Classification Search
CPC ..... F04D 29/4206; F04D 29/624
USPC ..... 415/206, 213.1, 214.1
See application file for complete search history.

(56) References Cited

U.S. PATENT DOCUMENTS 1,352,276 A * 9/1920 Junggren ..... 415/135
1,692,537 A * 11/1928 Baumann ..... 415/136
3,592,557 A * 7/1971 Haas et al. ..... 415/136
3,628,884 A 12/1971 Mierley
3,733,145 A * 5/1973 Kaplansky et al. ..... 415/112
4,380,405 A 4/1983 Kaneki et al.
6,868,366 B1 * 3/2005 Eisenzopf ..... 702/182

FOREIGN PATENT DOCUMENTS

JP A-47-1152 1/1972
JP A-56-098600 * 8/1981 ..... F04D 29/42
JP 6-249186 9/1994
JP A-08-232885 9/1996
JP A-2005-351185 A 12/2005

OTHER PUBLICATIONS

JP Office Action of Appln. No. 2010-142161 dated Oct. 16, 2012 with English translation.

* cited by examiner

*Primary Examiner* — Nathaniel Wiehle
*Assistant Examiner* — Woody A Lee, Jr.
(74) *Attorney, Agent, or Firm* — Mattingly & Malur, PC

(57) ABSTRACT

In a centrifugal compressor, for the purpose of preventing the positions of a diaphragm and a head flange in a radial direction from moving with respect to a casing, preventing the unstable vibration of the rotor and enabling an efficient and stable operation even on high-pressure conditions, there is provided a barrel-shaped centrifugal compressor including a casing, a diaphragm located in the casing to define a flow channel, and a head flange attached to the end of the casing by a shear key, wherein in the inner peripheral surface of the casing and the outer peripheral surface of abutment portions of the diaphragm and the head flange in which they are abutted on the inner peripheral surface of the casing, sliding key grooves which are vertical to the surfaces are provided at least two portions in a peripheral direction, and sliding keys are provided in the key grooves.

8 Claims, 8 Drawing Sheets

BARREL-SHAPED CENTRIFUGAL COMPRESSOR

FIELD OF THE INVENTION

The present invention relates to a barrel-shaped centrifugal compressor, and more particularly, it relates to an assembly structure of a diaphragm and a head flange of a centrifugal compressor.

DESCRIPTION OF RELATED ART

A centrifugal compressor includes a casing in which a flow channel is formed by a diaphragm, and compresses a gas sucked through a suction port by the rotation of impellers to discharge the gas through a discharge port. A pressure of the gas is held by a casing, a head flange provided at the end of the casing and a shear key which presses the head flange. A rotor having the impellers is rotatably supported by bearings attached to the head flange.

In the casing, the gas compressed by the impellers are sealed by an eye labyrinth seal of impellers eye portion, an interstage labyrinth seal between impeller stages, and a balance piston labyrinth seal provided in the final stage. As shown in, for example, FIG. 1 of JP-A-6-249186, the labyrinth seal has a structure including a plurality of ring-like teeth in a gap between a rotor and a stator, and owing to a pressure loss of a fluid flowing through tip gaps of the teeth, the leakage of the fluid is decreased. In this labyrinth seal, when a shaft is displaced in a radial direction with respect to the seal in a state where a leakage flow in the seal has a circumferential velocity, unbalance occurs in a circumferential pressure distribution in the seal, to generate a fluid force which causes the unstable vibration of the rotor (hereinafter referred to as the unstable fluid force). In particular, when the rotor rotates at a high speed or when a differential pressure between an inlet and an outlet of the seal is large, the unstable fluid force becomes larger, which might cause the unstable vibration of the rotor.

When the pressure in the casing becomes high, the casing expands owing to an internal pressure, whereby a gap is made among the inner peripheral surface of the casing, a diaphragm and a head flange, and the positions of the diaphragm and head flange in the radial direction might move with respect to the casing. When the positions of the diaphragm and head flange in the radial direction move with respect to the casing, the rotor supported by the bearings and the labyrinth seal attached to the diaphragm also relatively move, and the tip gap of the labyrinth seal might partially decrease. When the tip gap decreases, the increase of the unstable fluid force or contact of the teeth with the rotor might be caused. On the other hand, when the tip gap is enlarged to avoid this problem, the leakage increases to lower an efficiency.

BRIEF SUMMARY OF THE INVENTION

An object of the present invention is to provide a centrifugal compressor which enables a stable operation even on high pressure conditions while suppressing leakage from a seal.

To achieve the above object, according to the present invention, there is provided a barrel-shaped centrifugal compressor comprising a casing, a diaphragm located in the casing to form a flow channel, and a head flange attached to the end of the casing by a shear key, wherein in an inner peripheral surface of the casing and outer peripheral surfaces of contact portions of the diaphragm and the head flange in which they contact with the inner peripheral surface of the casing, at least two sliding key grooves which are vertical to the surfaces are provided in a peripheral direction, and sliding keys are provided in the key grooves.

According to the present invention, it is possible to prevent the movement of the diaphragm and the head flange in the radial direction with respect to the casing, and hence the decrease of tip gaps of labyrinth seal teeth is suppressed, whereby the increase of an unstable fluid force and the contact of the teeth with a rotor are avoided, and the rotor can be stabilized.

Other objects, features and advantages of the invention will become apparent from the following description of the embodiments of the invention taken in conjunction with the accompanying drawings.

DETAILED DESCRIPTION OF THE INVENTION

Hereinafter, embodiments of the present invention will be described with reference to the drawings.

Figure 1A:
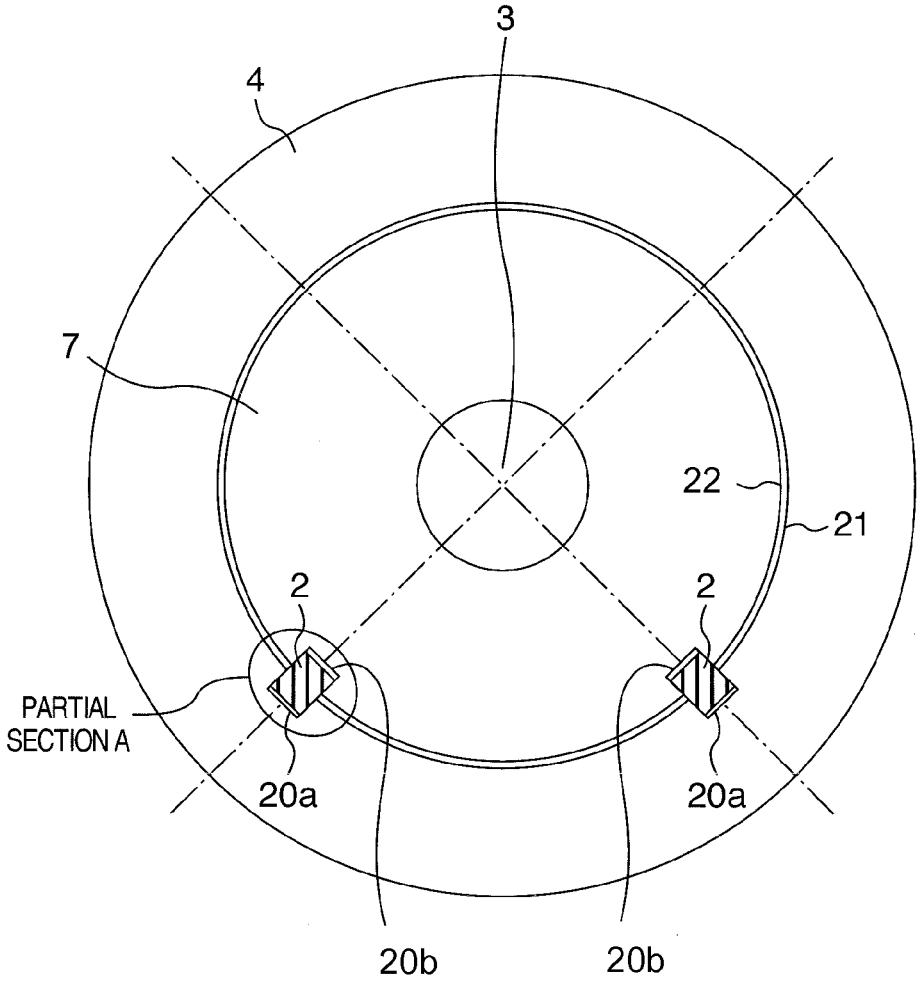
FIG. 1A and FIG. 1B are sectional views which are vertical to a rotating shaft and which show a portion of the sliding key of a centrifugal compressor of an embodiment according to the invention.
Figure 1B:
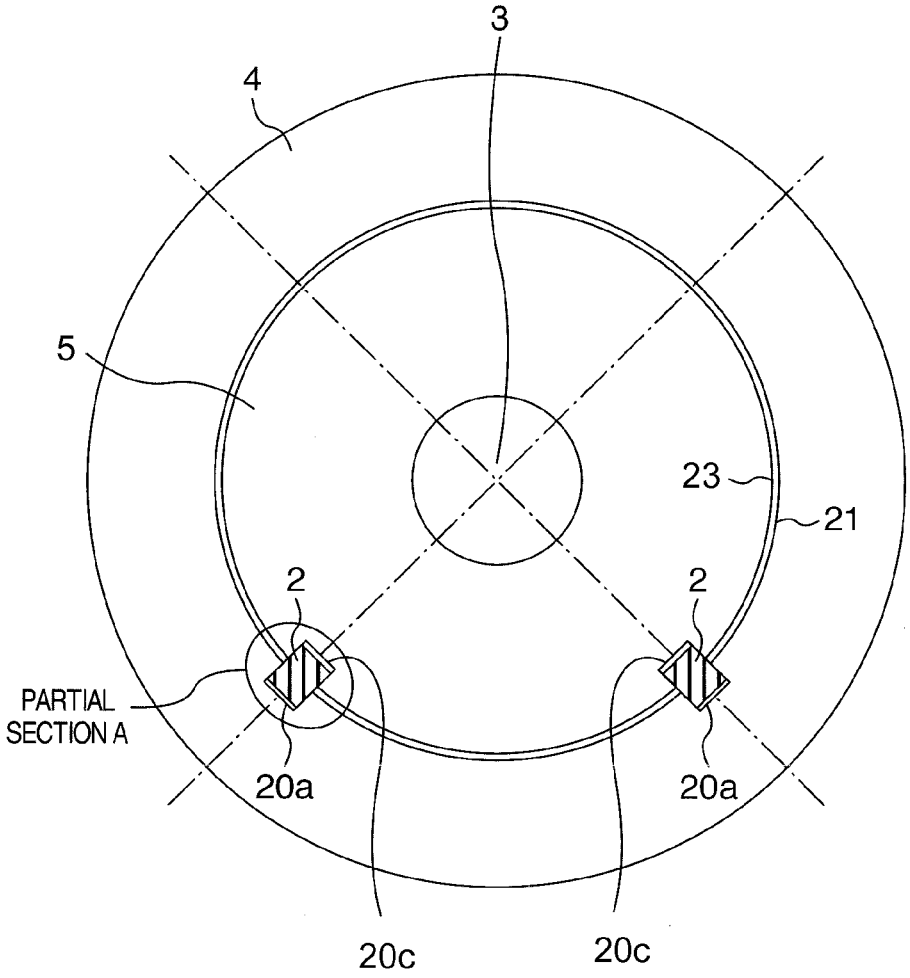
Figure 2:
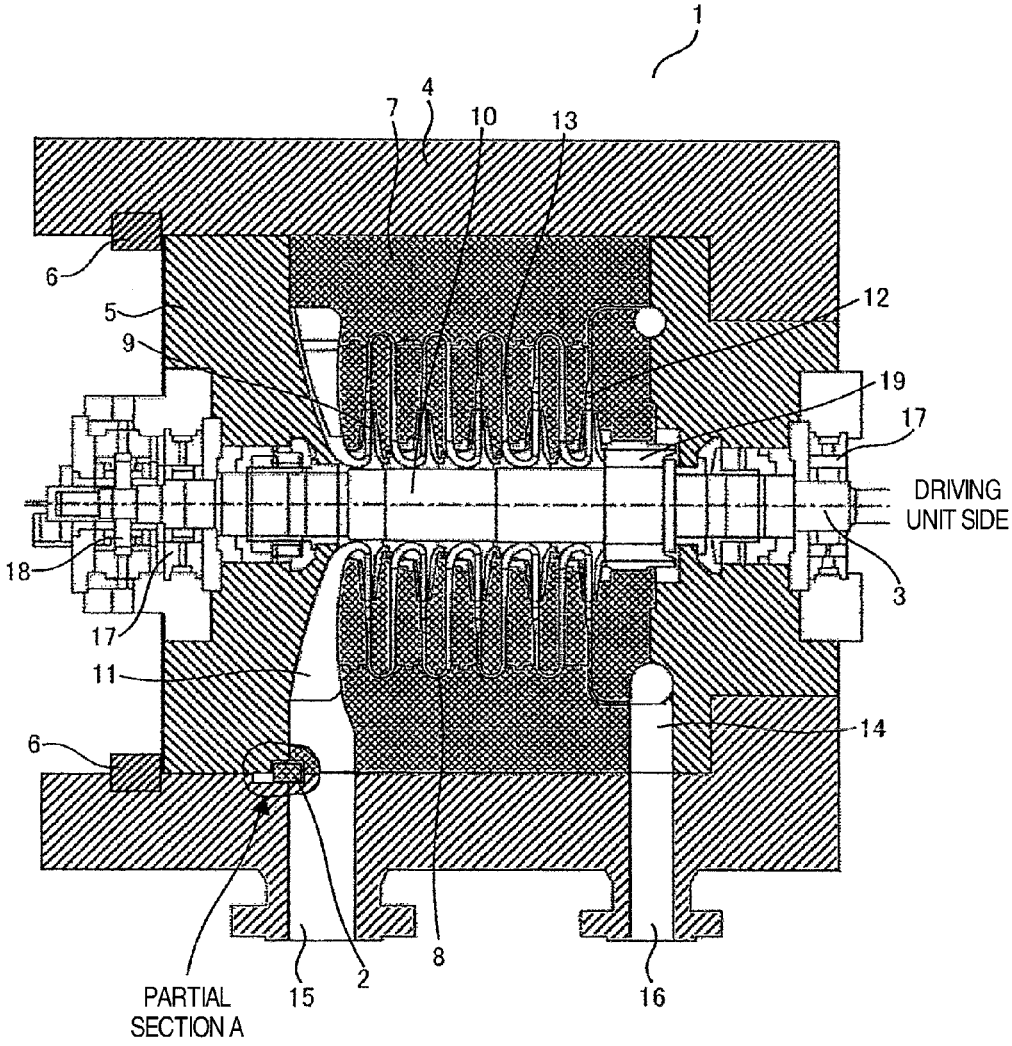
FIG. 2 is a sectional view which is parallel to a rotating shaft and which shows a whole structure of the centrifugal compressor of the embodiment.

FIG. 2 is a sectional view which is parallel to a rotating shaft 3 and which shows a whole structure of a centrifugal compressor 1 of an embodiment according to the invention, and FIG. 1A and FIG. 1B are diagrams showing sections of a locating portion for a sliding key 2 of the centrifugal compressor 1, which is vertical to the rotating shaft 3.

In FIG. 2, a pressure in the centrifugal compressor 1 is kept by a barrel-shaped casing 4 and a head flange 5 located at the end of the casing 4. The head flange 5 is held by several shear keys 6 divided in a peripheral direction. In the casing 4, a flow channel 8 is defined by a diaphragm 7 having a vertically dividable structure in the drawing. In the center of the diaphragm 7, there is disposed a rotor 10 including the rotating shaft 3 and a plurality of stages (e.g., five stages in FIG. 2) of impellers 9 mounted on the rotating shaft 3. In the diaphragm 7, there are formed a suction flow channel 11 through which a gas is introduced into the first-stage impellers 9, a diffuser 12 which converts kinetic energy of the gas discharged from each-stage impellers 9 to pressure energy, a return channel 13 through which the compressed gas from the diffuser 12 is introduced into the next-stage impellers 9, and a discharge flow channel 14 through which the gas is discharged from the final-stage impellers 9. The casing 4 is provided with a suction port 15 and a discharge port 16, and the ports are connected to the suction flow channel 11 and the discharge flow channel 14 of the diaphragm, respectively.

The rotor 10 is rotatably supported via radial bearings 17 provided at the end of the rotor on a suction side (the left side of FIG. 2) and the end thereof on a discharge side (the right side of FIG. 2). Moreover, at the suction-side end of the rotor 10 is provided a thrust bearing 18 which is subjected to a thrust load, and at the discharge-side end thereof is provided a balance piston 19 which offsets the thrust load. Moreover, at the discharge-side end, the rotor 10 is connected to a driving unit (not shown) such as a motor, and by the driving of the driving unit, the rotor 10 is rotated. Moreover, by the rotation of the rotor 10, the gas is sucked through the suction port 15, successively compressed by the plurality of stages of impellers 9, and finally discharged through the discharge port 16.

During assembling, after locating the rotor 10 in the diaphragm 7, the diaphragm 7 and the head flange 5 are inserted into the casing 4 in this order from the left side of FIG. 2, and the head flange 5 is held by the shear keys 6. Afterward, the radial bearings 17 and the like are located. Disassembling is performed in a reverse procedure.

In a gap between each-stage impellers 9 and the diaphragm 7 is provided a labyrinth seal, whereby the gas discharged form the impellers 9 is prevented from returning to the inlet side of the impellers 9 or the previous-stage impellers 9 through the gap. Moreover, in a gap between the balance piston 19 and the diaphragm 7 is also provided a labyrinth seal, whereby the high-pressure gas discharged from the final-stage impellers 9 is prevented from leaking to a low pressure portion (a gap between the casing 4 and the diaphragm 7 or the suction flow channel 11) in the casing 4. A partial section A which is an abutment portion of the diaphragm 7 and the head flange 5 with respect to the casing 4 will be described later in detail with reference to FIG. 3A, FIG. 3B, and FIG. 4.

In FIG. 1A as a sectional view which is vertical to the rotating shaft 3, in a casing inner peripheral surface 21 and a diaphragm outer peripheral surface 22, sliding key grooves 20*a* and 20*b* which are vertical to the surfaces, respectively, are provided at two portions, and sliding keys 2 are inserted into the grooves. At this time, the sliding key grooves 20*a* and 20*b* are provided below a horizontal plane passing the center of the casing inner peripheral surface 21, thereby enhancing ease of assembling/disassembly work. It is to be noted that the locating portions for the sliding key 2 in the casing inner peripheral surface 21 and the diaphragm outer peripheral surface 22 have been described above with respect to FIG. 1A, and a structure in the casing inner peripheral surface 21 and a head flange outer peripheral surface 23 is similar to the above structure, and is shown in FIG. 1B including the head flange 5.

Figure 3A:
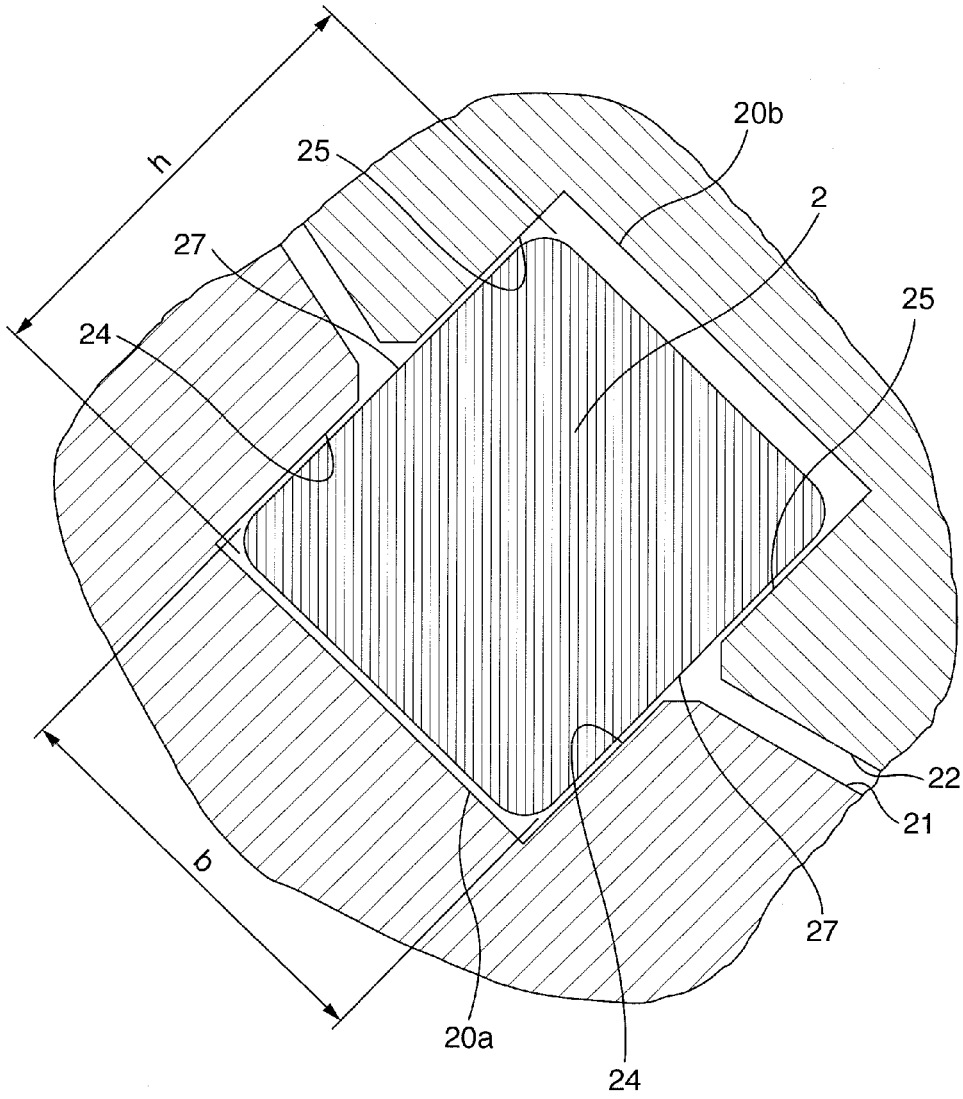
FIG. 3A and FIG. 3B are sectional views which are vertical to the rotating shaft and which show the enlarged sliding key locating portion of the centrifugal compressor of the embodiment.
Figure 3B:
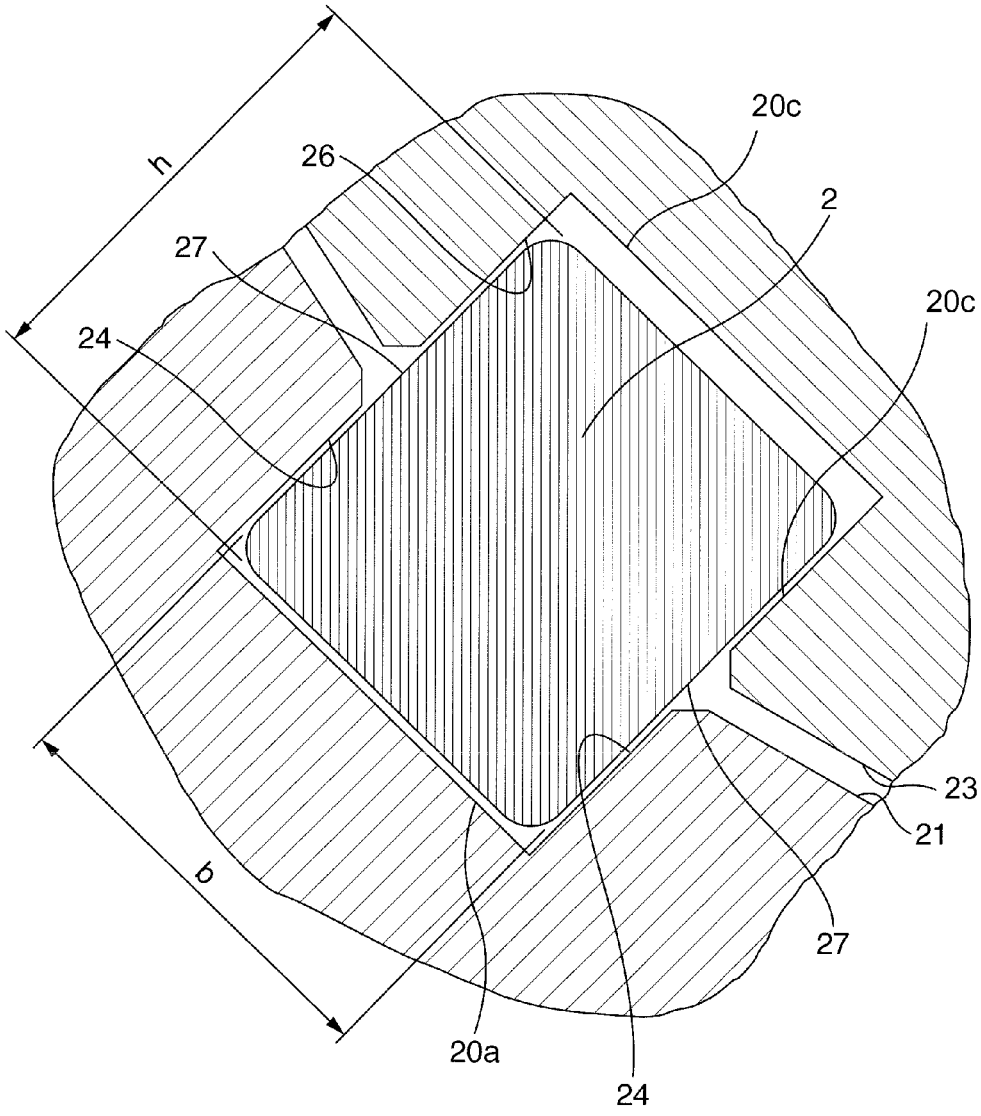

FIG. 3A is a sectional view showing the enlarged partial section A shown in FIG. 1A. FIG. 3B is a sectional view showing the enlarged partial section A shown in FIG. 1B. The sliding key grooves 20*a* and 20*b* and a sliding key groove 20*c* have the same width (b), and the sliding key groove 20*a* is provided vertically in the casing inner peripheral surface 21 so that a side surface 24 (a sliding surface) of the sliding key groove 20*a* becomes parallel to a straight line passing through the center of the key groove width and the center of the casing inner peripheral surface 21. The sliding key groove 20*b* is provided vertically in the diaphragm outer peripheral surface 22 so that a side surface 25 (a sliding surface) becomes parallel to a straight line passing through the center of the key groove width and the center of the diaphragm outer peripheral surface 22. It is to be noted that the locating portions for the sliding key 2 in the casing inner peripheral surface 21 and the diaphragm outer peripheral surface 22 have been described above with respect to FIG. 3A, and a structure of the locating portions for the sliding key in the casing inner peripheral surface 21 and the head flange outer peripheral surface 23 is similar to the above structure, and is shown in FIG. 3B in the case of the head flange 5. Side surfaces 27 (sliding surfaces) of the sliding key 2 are parallel to each other. In this manner, when the sliding key grooves 20*a*, 20*b* and 20*c* and the sliding keys 2 are provided, the diaphragm 7 and the head flange 5 can move only in a radial direction with respect to the casing 4. Furthermore, as shown in FIG. 1A and FIG. 1B, sliding keys 2 are provided at two portions in the peripheral direction so that moving directions of the two sliding keys 2 intersect with each other at the center of the rotating shaft 3, whereby the only relative movement held around the same center is allowed. In consequence, even when the casing 4 expands owing to an internal pressure and gaps between the casing inner peripheral surface 21 and the diaphragm outer peripheral surface 22 and between the casing inner peripheral surface 21 and the head flange outer peripheral surface 23 enlarge, the casing 4, the diaphragm 7 and the head flange 5 can constantly hold the same center.

Figure 4:
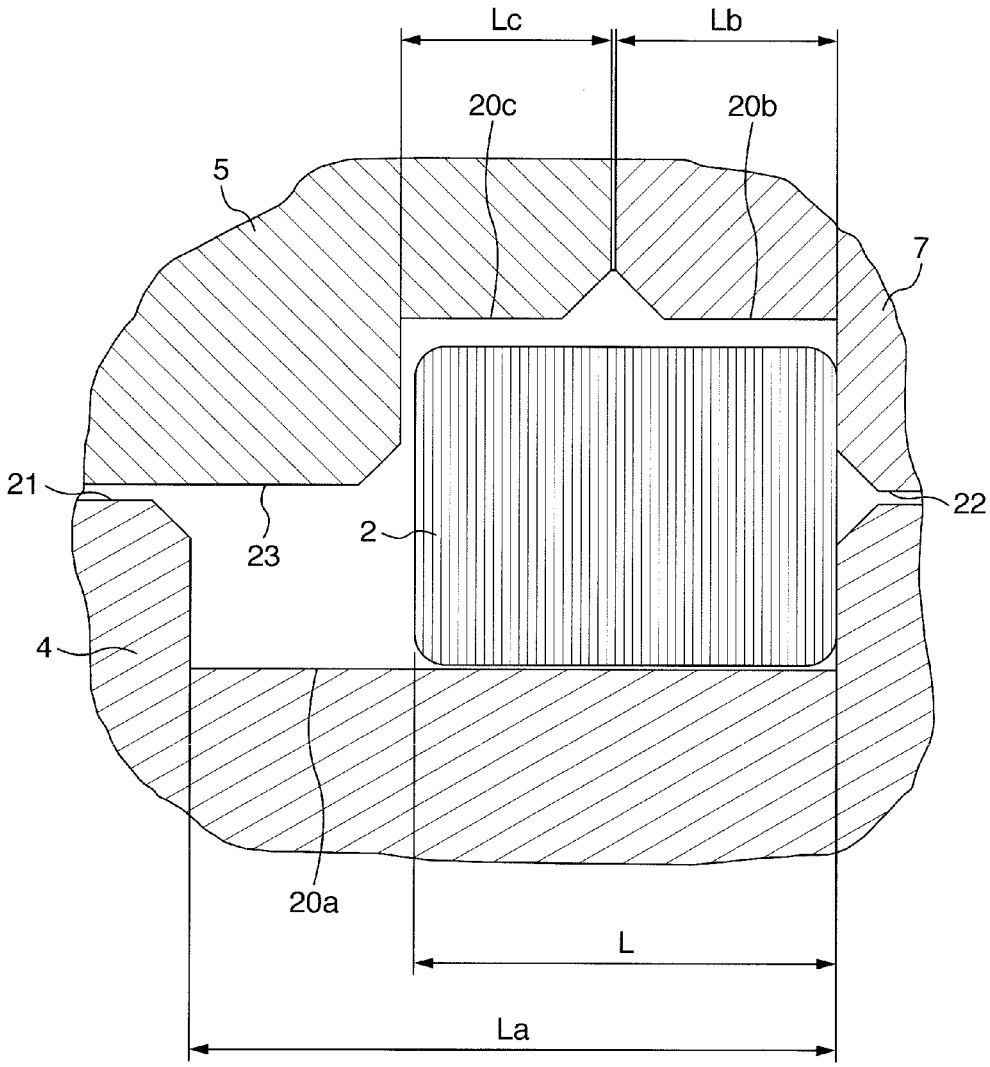
FIG. 4 is a sectional view which is parallel to the rotating shaft and which shows the enlarged sliding key locating portion of the centrifugal compressor of the embodiment.

FIG. 4 is a sectional view which is parallel to the rotating shaft and which shows the enlarged partial section A of FIG. 2. As shown in FIG. 4, when the abutment portions of the diaphragm 7 and the head flange 5 with respect to the casing 4 are provided with the sliding key 2, these three components can be held around the same center at the same time. Moreover, an axial length La of the sliding key groove 20*a* in the casing inner peripheral surface 21 is set to be larger than a sum of an axial length L of the sliding key 2 and an axial length Lb of the key groove 20*b* in the diaphragm. Moreover, the axial length Lb of the key groove 20*b* in the diaphragm and an axial length Lc of the key groove 20*c* in the head flange are set to be smaller than the axial length L of the sliding key 2, respectively, with the proviso that the sum of Lb and Lc is set to be larger than L so that sliding is not constrained. In consequence, while the sliding keys 2 are securely operated, during the assembling and disassembling, an attaching operation of the sliding keys 2 can easily be performed. In the present embodiment, each of Lb and Lc is set to be larger than the half of L. After locating the diaphragm 7 in the casing 4, the sliding keys 2 are inserted into the sliding key grooves 20*a*, and the inserted sliding keys are slid toward the diaphragm 7 and inserted into the sliding key grooves 20*b*. Afterward, when the head flange 5 is located, the sliding keys 2 are also inserted into the sliding key grooves 20*c*, whereby the assembling can be performed as shown in FIG. 4.

A dimension of the sliding key 2 is determined so that the key bears the own weights of the diaphragm 7 and the head flange 5 and a variable load due to vibration during the operation of the centrifugal compressor 1. In the centrifugal compressor in which the casing 4 has an outer diameter of about 1300 mm, the length L, the width b and a height h of the sliding key 2 may be about 100 mm, 60 mm, and 60 mm, respectively.

As described above, according to the centrifugal compressor of the embodiment described with reference to FIG. 1A to FIG. 4, it is possible to prevent the unstable vibration of the rotor during a high-pressure operation. Specifically, in the casing inner peripheral surface and the outer peripheral surfaces of the abutment portion of the diaphragm and the head flange, sliding key grooves which are vertical to the surfaces are provided at least two portions in the peripheral direction, and the sliding keys are provided in the key grooves, whereby the movement of the diaphragm and the head flange in the radial direction with respect to the casing can be prevented. In consequence, the decrease of the tip gaps of the labyrinth seal teeth is suppressed, and the increase of an unstable fluid force and the contact of the teeth with the rotor are avoided, whereby the rotor can be stabilized. Moreover, when the key grooves are located at the positions below the horizontal plane passing the center of the casing, during the assembling and disassembling, the casing inner peripheral surface can be prevented from being damaged by wrongly dropped keys. Furthermore, the key grooves are provided at two positions which do not face each other in the peripheral direction, and hence the increase of a processing amount and the increase of an operation amount during the assembling and disassembling are suppressed, whereby the above effect can be obtained at the lowest cost.

Figure 5A:
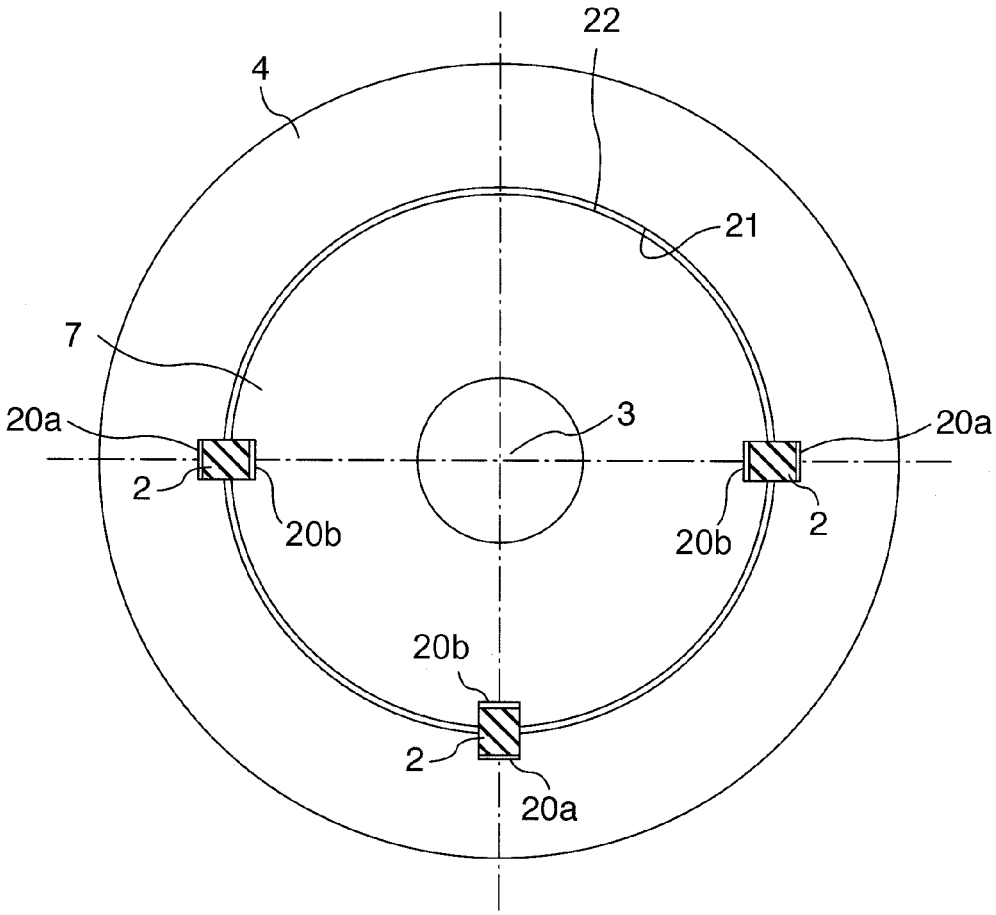
FIG. 5A and FIG. 5B are sectional views which are vertical to a rotating shaft and which show a sliding key locating portion of a centrifugal compressor of another embodiment according to the invention.
Figure 5B:
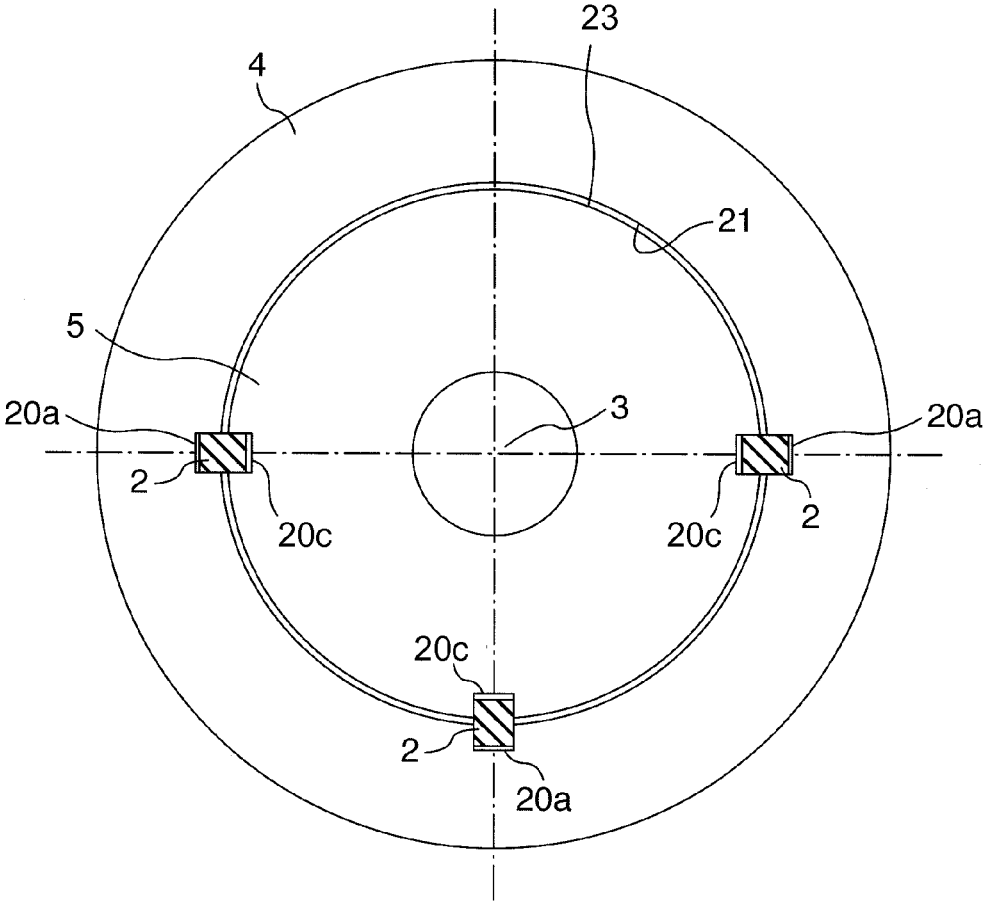

It is to be noted that in the above embodiment, the two sliding keys 2 are symmetrically arranged, but do not have to be symmetrically arranged. Moreover, in the embodiment, two sliding keys 2 are arranged so that the keys do not face each other. However, as shown in FIG. 5A and FIG. 5B, also when a pair of sliding keys 2 facing each other and at least one sliding key 2 are provided, a casing 4, a diaphragm 7 and a head flange 5 can be held around the same center.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A barrel-shaped centrifugal compressor comprising:

a casing, a diaphragm located in the casing to form a flow channel, and a head flange attached to an end of the casing by a shear key, wherein the shear key is divided into several parts in a peripheral direction and arranged outside of the flow channel between the head flange and the end of the casing, and wherein in an inner peripheral surface of the casing and the outer peripheral surface of contact portions of the diaphragm and the head flange which contact with the inner peripheral surface of the casing, sliding key grooves which are vertical to the surfaces are provided in at least two portions in a peripheral direction, on a side of the flow channel across the head flange from the shear key, and sliding keys are provided in the key grooves.

2. The centrifugal compressor according to claim 1, wherein the sliding key grooves are provided at two positions which do not face each other in the peripheral direction.

3. The centrifugal compressor according to claim 2, wherein the sliding key grooves are provided so as to be positioned below a horizontal plane passing the center of the casing.

4. A barrel-shaped centrifugal compressor comprising:

a rotating shaft including a plurality of stages of impellers mounted thereon, a vertically dividable diaphragm surrounding the rotating shaft to define a flow channel, a casing containing the diaphragm, and a head flange located at an end of the casing, wherein a shear key is divided into several parts in a peripheral direction and arranged outside of the flow channel between the head flange and the end of the casing, and wherein a first sliding key groove and a second sliding key groove are provided in an outer peripheral surface of the diaphragm, which is on a side of the flow channel across the head flange from the shear key, the casing is provided with a third sliding key groove and a fourth sliding key groove in an inner peripheral surface thereof, a first sliding key is disposed in the first sliding key groove and the third sliding key groove, a second sliding key is disposed in the second sliding key groove and the fourth sliding key groove, and a moving direction of the first sliding key and a moving direction of the second sliding key intersect with each other at the center of the rotating shaft.

5. The centrifugal compressor according to claim 1, wherein an axial length of the sliding key groove provided in the inner peripheral surface of the casing is set to be longer than a sum of an axial length of the sliding key and an axial length of the sliding key groove in the diaphragm, and wherein the axial length of the sliding key groove provided in the diaphragm is set to be smaller than the axial length of the sliding key, an axial length of the sliding key groove provided in the head flange is set to be smaller than the axial length of the sliding key, and a sum of the axial length of the sliding key groove provided in the diaphragm and the axial length of the sliding key groove provided in the head flange is set to be longer than the axial length of the sliding key.

6. The centrifugal compressor according to claim 4, wherein an axial length of the third sliding key groove provided in the inner peripheral surface of the casing is set to be longer than a sum of an axial length of the first sliding key and an axial length of the first sliding key groove provided in the diaphragm, and wherein an axial length of the fourth sliding key groove provided in the inner peripheral surface of the casing is set to be longer than a sum of an axial length of the second sliding key and an axial length of the second sliding key groove provided in the diaphragm.

7. A barrel-shaped centrifugal compressor comprising:

a casing, a diaphragm located in the casing to form a flow channel, and a head flange attached to an end of the casing by a shear key, wherein in an inner peripheral surface of the casing and the outer peripheral surface of contact portions of the diaphragm and the head flange which contact with the inner peripheral surface of the casing, sliding key grooves which are vertical to the surfaces are provided in at least two portions in a peripheral direction, and sliding keys are provided in the key grooves, and wherein an axial length of the sliding key groove provided in the inner peripheral surface of the casing is set to be longer than a sum of an axial length of the sliding key and an axial length of the sliding key groove in the diaphragm, and wherein the axial length of the sliding key groove provided in the diaphragm is set to be smaller than the axial length of the sliding key, an axial length of the sliding key groove provided in the head flange is set to be smaller than the axial length of the sliding key, and a sum of the axial length of the sliding key groove provided in the diaphragm and the axial length of the sliding key groove provided in the head flange is set to be longer than the axial length of the sliding key.

8. A barrel-shaped centrifugal compressor comprising:

a rotating shaft including a plurality of stages of impellers mounted thereon, a vertically dividable diaphragm surrounding the rotating shaft to define a flow channel, a casing containing the diaphragm, and a head flange located at an end of the casing, wherein the diaphragm is provided with a first sliding key groove and a second sliding key groove in an outer peripheral surface thereof, the casing is provided with a third sliding key groove and a fourth sliding key groove in an inner peripheral surface thereof, a first sliding key is disposed in the first sliding key groove and the third sliding key groove, a second sliding key is disposed in the second sliding key groove and the fourth sliding key groove, wherein an axial length of the third sliding key groove provided in the inner peripheral surface of the casing is set to be longer than a sum of an axial length of the first sliding key and an axial length of the first sliding key groove provided in the diaphragm, wherein an axial length of the fourth sliding key groove provided in the inner peripheral surface of the casing is set to be longer than a sum of an axial length of the second sliding key and an axial length of the second sliding key groove provided in the diaphragm, and wherein a moving direction of the first sliding key and a moving direction of the second sliding key intersect with each other at the center of the rotating shaft.

* * * * *